US005508674A

United States Patent [19]

Girgis et al.

[11] Patent Number: 5,508,674

[45] Date of Patent: Apr. 16, 1996

[54] CORE-FORM TRANSFORMER

[75] Inventors: Ramsis S. Girgis; William N. Kennedy, both of Muncie; Chung-Duck Ko, Anderson, all of Ind.; Carl M. Pandza, Allison Park, Pa.

[73] Assignee: Electric Power Research Institute, Inc., Palo Alto, Calif.

[21] Appl. No.: 125,512

[22] Filed: Sep. 22, 1993

Related U.S. Application Data

[63] Continuation of Ser. No. 860,771, Mar. 25, 1992, abandoned.

[51] Int. Cl.[6] ..... H01F 27/30

[52] U.S. Cl. ..... 336/187; 336/205; 336/206; 336/223

[58] Field of Search ..... 336/186, 187, 336/205, 206, 223; 174/33, 117 F, 117 FR

[56] References Cited

U.S. PATENT DOCUMENTS

| | | | |
|---|---|---|---|
| 753,461 | 3/1904 | Anderson | 336/206 |
| 1,118,446 | 11/1914 | Roos | 336/206 |
| 1,411,619 | 4/1922 | Frank | 336/187 |
| 1,679,462 | 5/1927 | Palueff | 336/187 |
| 2,441,804 | 5/1948 | Farry | 336/187 |
| 2,958,059 | 10/1960 | Jarvis et al. . | |
| 2,978,530 | 4/1961 | Braeckman . | |
| 3,237,136 | 2/1966 | Ford . | |
| 3,312,775 | 4/1967 | Lambert . | |
| 3,466,584 | 9/1969 | Kashima . | |
| 3,467,931 | 9/1969 | Dutton . | |
| 3,501,728 | 3/1970 | Barriball . | |
| 3,546,644 | 12/1970 | Wilburn et al. . | |
| 3,579,084 | 5/1971 | Moyer . | |
| 3,586,757 | 6/1971 | Haldeman, Jr. | 174/177 FF |
| 3,647,932 | 3/1972 | Heller et al. . | |
| 3,688,233 | 8/1972 | Moore et al. . | |
| 3,723,797 | 3/1973 | Andersson et al. | 174/117 FF |
| 3,747,205 | 7/1973 | Moore | 336/206 |
| 3,891,955 | 6/1975 | Horton, III | 336/206 |
| 3,925,743 | 12/1975 | Van Nice . | |
| 4,013,987 | 3/1977 | Foster . | |
| 4,239,077 | 12/1980 | Dixon et al. . | |
| 4,395,693 | 7/1983 | Marinescu . | |
| 4,400,676 | 8/1983 | Mitsui et al. . | |
| 4,431,860 | 2/1984 | Perco et al. . | |
| 4,439,256 | 3/1984 | Meserve . | |
| 4,473,716 | 9/1984 | Jesseman . | |
| 4,489,210 | 10/1984 | Hall . | |
| 4,546,210 | 10/1985 | Akiba et al. . | |
| 4,549,042 | 10/1985 | Akiba et al. . | |
| 4,554,523 | 11/1985 | Miki et al. . | |
| 4,554,730 | 11/1985 | Westervelt et al. . | |
| 4,859,978 | 8/1989 | Feather et al. . | |
| 4,864,266 | 9/1989 | Feather et al. . | |

FOREIGN PATENT DOCUMENTS

| | | | |
|---|---|---|---|
| 2541871 | 3/1977 | Germany | 336/205 |
| 580524 | 2/1962 | Italy . | |
| 69846 | 8/1915 | Switzerland | 336/206 |
| 487426 | 5/1975 | U.S.S.R. | 336/187 |

*Primary Examiner*—Thomas J. Kozma

*Attorney, Agent, or Firm*—Flehr, Hohbach, Test, Albritton & Herbert

[57] ABSTRACT

An improved core-form transformer is disclosed. The core-form transformer includes a c-wrapped ribbon conductor with opposing wide sides and opposing thin sides. The c-wrapped ribbon conductor is wound around a core to form a plurality of coil sections. Adhesive is applied directly to one of the wide sides of the ribbon conductor to form a strong mechanical coupling within the coil sections. A novel transposing fold of the ribbon conductor is employed to create coil transpositions. The core-form transformer of the invention reduces circulating current losses while utilizing only a small number of transposing folds, generally adjacent to a first coil section, a last coil section, and an intermediate coil section.

7 Claims, 4 Drawing Sheets

CORE-FORM TRANSFORMER

This is a continuation, of application Ser. No. 07/860,771 filed Mar. 25, 1992, now abandoned.

BRIEF DESCRIPTION OF THE INVENTION

The present invention relates generally to core-form power transformers. More particularly, the present invention relates to an improved core-form power transformer which employs a c-wrapped ribbon conductor with a novel transposing fold and transposition scheme.

BACKGROUND OF THE INVENTION

Modern transformer windings are fabricated using a wide variety of methods. In high power applications, a rectangular shaped ribbon conductor may be wound about a core to form a coil. Adjacent coil sections may be coupled by complicated transposition folds of the ribbon conductor.

A typical ribbon conductor comprises parallel strands of insulated wire resulting in a wide, thin cable. The strands themselves may be rectangular for increased strength, and to provide a more compact transformer. For instance, the ribbon conductor may comprise five strands or ribbon conductor elements. The strands may be approximately 0.045 inches by 0.250 inches, with a typical range of 0.030 to 0.096 inches by 0.200 to 0.580 inches. The strands are coated with enamel. The ribbon conductor is then wrapped in an insulating paper.

When ribbon conductors are used in core-form transformers, the thinness of the conductors allows more turns to be wound into a coil section, resulting in a winding that has a fraction of the sections of a conventional coil. The greater width of the ribbon conductor allows a high series capacitance in the coil. This provides an improved voltage distribution across the coil sections and permits reduced section and turn insulation. The reduced insulation and the fewer coil sections result in a greatly improved space factor for the coil and hence a smaller core with lower winding weights and lower no load and load losses.

While ribbon conductors may be successfully employed to manufacture core-form transformers, there are still a number of shortcomings associated with existing devices. One shortcoming is that they are susceptible to mechanical weakness. In addition, it would be highly advantageous to further reduce the size of core-form transformers without reducing their capacity.

When core-form transformers are manufactured from ribbon conductors, a number of inefficiencies are associated with the manufacturing process. First, the insulating paper wrapped around the conductor typically forms a bulging and wasteful overlapping paper region on one side of the conductor. In addition, the creation of transpositions between coil sections typically entails a labor-intensive folding scheme.

In addition to the structural and manufacturing shortcomings of existing core-form transformers, there are some operating inefficiencies associated with these devices. Several factors influence transformer efficiency, but transformer efficiency is largely dependent upon reducing eddy currents and circulating currents within the windings. It is recognized that eddy currents are dependent to a large extent on the dimensions of the conductors. Specifically, eddy current losses may be significantly reduced by reducing the dimensions of the conducting strands. Ribbon conductors comprised of a number of finely stranded conductors, as previously described, significantly reduce eddy currents.

However, to prevent an offsetting increase in losses due to circulating currents between the parallel connected strands, the leakage flux must be minimized. This is accomplished by transposing the relative position of the strands in order to reduce the net flux linkages for each strand. In conventional transformers, circulating currents are reduced by placing a transposition in between essentially each coil section of the transformer. This approach is problematic in that it involves a large number of transpositions which, as previously discussed, are difficult and expensive to realize. The approach is also problematic to the extent that it does not achieve optimal reduction of circulating losses.

OBJECTS AND SUMMARY OF THE INVENTION

It is a general object of the present invention to provide an improved high-voltage core-form power transformer.

It is a more particular object of the present invention to provide an efficient core-form transformer with reduced operating losses.

It is another object of the present invention to provide a core-form transformer which is easier to manufacture.

It is still another object of the present invention to provide a smaller core-form transformer without compromising operating parameters.

These and other objects are obtained by an improved core-form transformer in accordance with the invention. The core-form transformer includes a c-wrapped ribbon conductor with opposing wide sides and opposing thin sides. The c-wrapped ribbon conductor is wound around a core to form a plurality of coil sections. Adhesive is applied directly to one of the wide sides of the ribbon conductor to form a strong mechanical coupling within the coil sections. A novel transposing fold of the ribbon conductor is employed to create coil transpositions. The core-form transformer of the invention reduces circulating current losses while utilizing only a small number of transposing folds, generally adjacent to a first coil section, a last coil section, and an intermediate coil section.

BRIEF DESCRIPTION OF THE DRAWINGS

For a better understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION OF THE INVENTION

Figure 1:
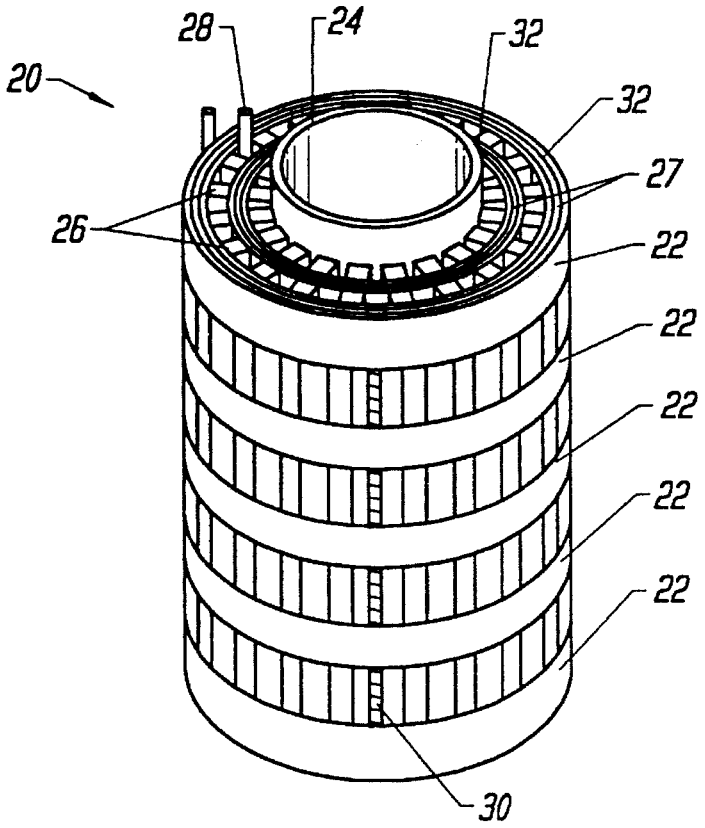
FIG. 1 is a perspective view of a core-form power transformer in accordance with the present invention.

FIG. 1 depicts a core-form transformer 20. The core-form transformer 20 includes a number of coil sections 22 wound around a central cylinder 24. Axial cooling ducts 26 are preferably provided between concentric coil segments 27. Tap connectors 28 are also provided in accordance with prior art techniques. As will be more fully described below, axial crossover connectors 30 between coil sections 22 are provided in accordance with the invention.

Figure 2:
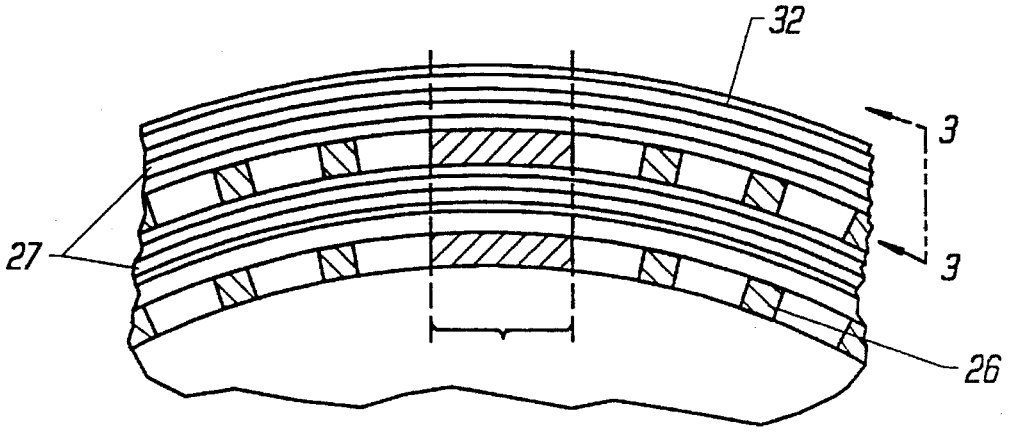
FIG. 2 is a sectional top view of the core-form power transformer of FIG. 1.

Turning to FIG. 2, a top sectional view of the core-form transformer 20 of FIG. 1 is provided. The figure depicts axial cooling ducts 26 between concentric coil segments 27. Each coil segment 27 comprises multiple turns of radially wound ribbon conductor 32.

Figure 3:
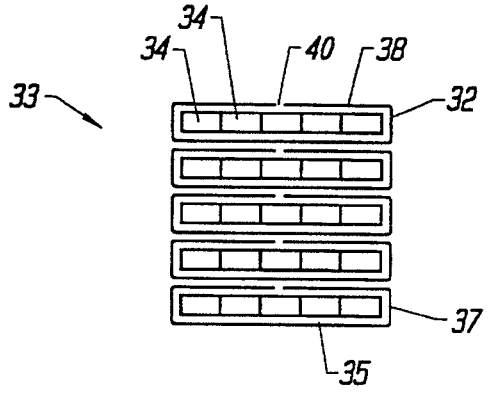
FIG. 3 is a sectional view of a radial stack of ribbon conductors taken along the line 3—3 of FIG. 2.

FIG. 3, a view taken along the line 3—3 of FIG. 2, depicts the nature of a radial stack of ribbon conductors 33 forming a coil segment 27. By way of example, the ribbon conductor 32 includes five strands or ribbon elements 34. The ribbon conductor 32 includes opposing wide sides 35 and opposing thin sides 37.

Under prior art techniques, each ribbon conductor 32 is completely wound with a paper insulator, resulting in a region with overlapping paper. In accordance with the present invention, a c-wrap paper 38 is provided. As used herein, c-wrap paper refers to paper which covers one wide side 35 and both thin sides 37 of the ribbon conductor 32, but which does not overlap on the opposite wide side of the ribbon conductor, thereby forming a c-wrap gap 40. In other words, the c-wrap 38 of the present invention does not result in a region with overlapping paper. Consequently, the insulating paper does not include a bulky overlapping region, thereby enabling a smaller structure. Moreover, less paper is used.

Still referring to FIG. 3, in a preferable embodiment of the present invention, a bonding agent, such as an epoxy, is applied to one of the wide sides of each ribbon conductor 32. The ribbon conductor is then wound tightly in a concentric configuration. The structure is then heated. As a result, a solid structural coil is formed.

In prior art devices, adhesive paper is placed between each ribbon conductor 32. Adhesive paper results in a bulkier transformer. In contrast, with the present invention, the bulk of the adhesive paper is eliminated and the bonding agent is applied directly to one of the wide sides of the ribbon conductor 32. Moreover, the manufacturing difficulties of accurately positioning the adhesive paper is eliminated. Finally, the difficulty of working with the double sided adhesive paper is also eliminated.

Figure 4:
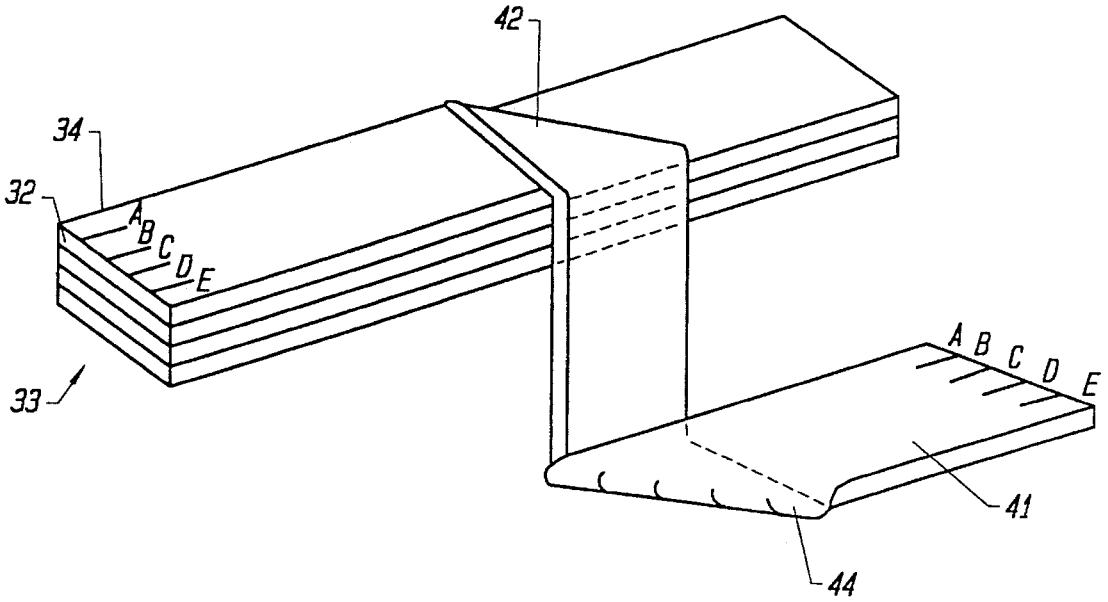
FIG. 4 is a perspective view of a matched conductor fold between coil sections of a transformer.

Turning now to FIG. 4, a radial stack of ribbon conductors 33 is depicted in perspective. Each ribbon conductor 32 includes 5 strands (A,B,C,D,E). As used herein, the "inside" corresponds to the position of strand "A" in the stack of ribbon conductors 33 of FIG. 4. The "outside" corresponds to the position of strand "E" in the stack of ribbon conductors of FIG. 4. In describing the folding scheme associated with the invention, an "angled fold" refers to a fold of approximately 45°, while a "straight crease" refers to a crease of approximately 90°.

FIG. 4 depicts a scheme for placing a coil section 22 in a matched relationship with an adjacent coil section 22. In other words, with the folding scheme of FIG. 4, "strand A" is on the inside in the first coil section and is also on the inside in the adjacent coil section which is wound outward beginning with cable segment 41.

The top conductor 32 of the radial stack of conductors 33 is first subjected to an outside angled fold 42. In other words, the inside strand A is folded toward the outside strand. The conductor is then positioned along the stack of conductors 33 and extends as a crossover connector 30 to a new coil section. At the location at which a new coil section is to be formed, an in-line angled fold 44 is formed. That is, an angled fold is created to place the conductor in-line to form a new coil section. Thus, the conductor is wound about the core 24 to form a new coil section 22 which is matched with the adjacent coil 22 section. In sum, each coil section 22 is "upwound" from the core 24 out to the perimeter of the coil section 22. In many prior art transformers there are manufacturing difficulties since a new coil section is "downwound" from the outer perimeter of the coil section down to the core.

Figure 5:
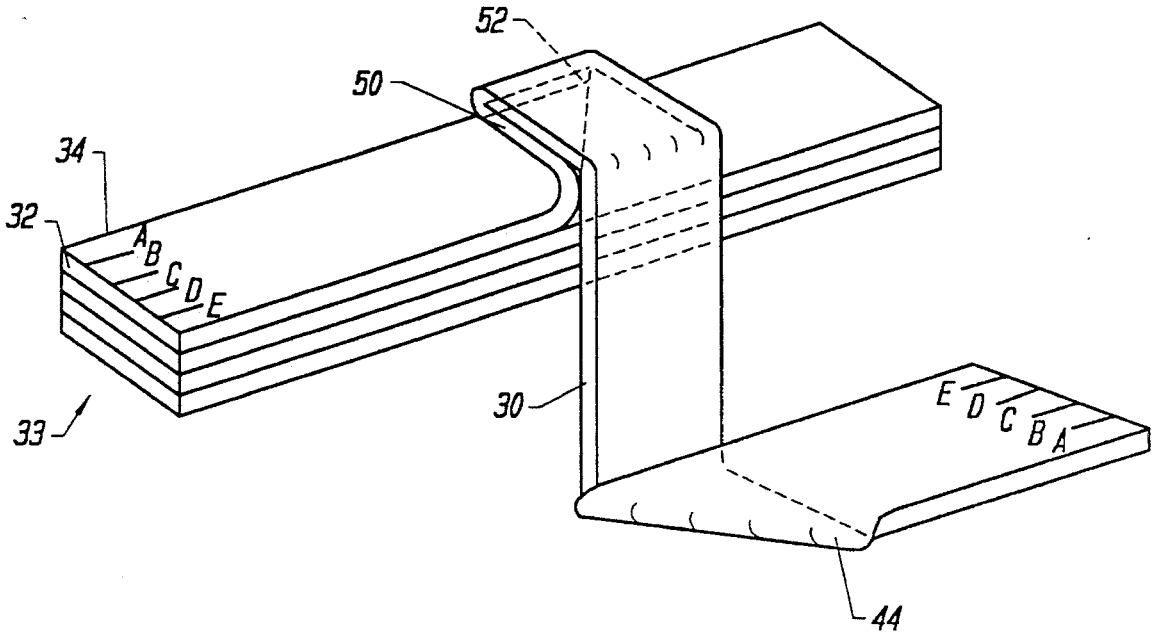
FIG. 5 is a perspective view of a transposed conductor fold between coil sections of a transformer.

Turning now to FIG. 5, a novel transposing fold in accordance with the invention is disclosed. With the transposing fold of FIG. 5, a transposed conductor is formed between coil sections. In other words, strand A is on the inside of the first stack of conductors, but after the transposing fold, strand E is on the inside of what will be a wound stack of conductors forming a new coil section. Transpositions are used to reduce flux leakage.

A preferable transposing fold may be accomplished in the following manner. First, an angled fold inside 50 is made. That is, an angled fold from the outside to the inside is made. Thereafter, a straight crease outside 52 is made. The extending conductor 32 is positioned along the stack of conductors 33, and then extends as a crossover connector 30 to a new location where a coil section is to be formed. At that location, an angled fold in-line 44 is made and the conductor is wound into a coil section 22. As a result of the transposing fold of FIG. 5, transposed coil sections are produced.

The transposing fold of FIG. 5 is an advantageous improvement over the prior art which utilizes a complicated folding structure. Consequently, with the transposing fold of the present invention, transpositions are readily realized with minimal manufacturing expense. One skilled in the art will recognize that ribbon conductors 33 may be wound over the stack of conductors 33 and that these overwound conductors may also be subjected to transposing folds. In other words, a transposing fold may be made in one ribbon conductor, while another ribbon conductor is wound over the folded ribbon conductor and is then itself folded after several winds.

Figure 6:
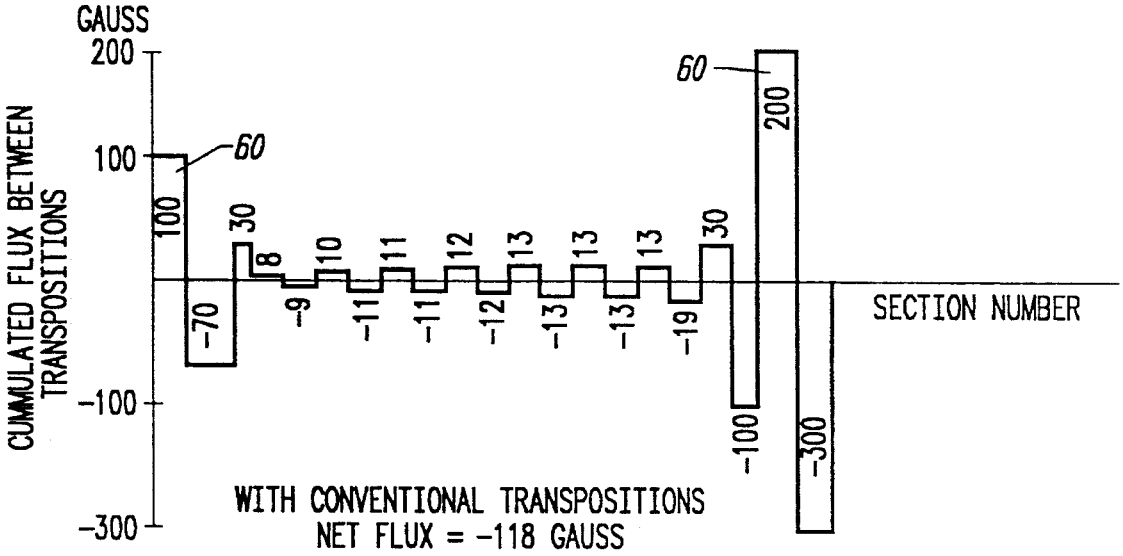
FIG. 6 is a diagrammatic representation of transformer transpositions and resultant flux leakage associated with prior art core-form transformers.
Figure 7:
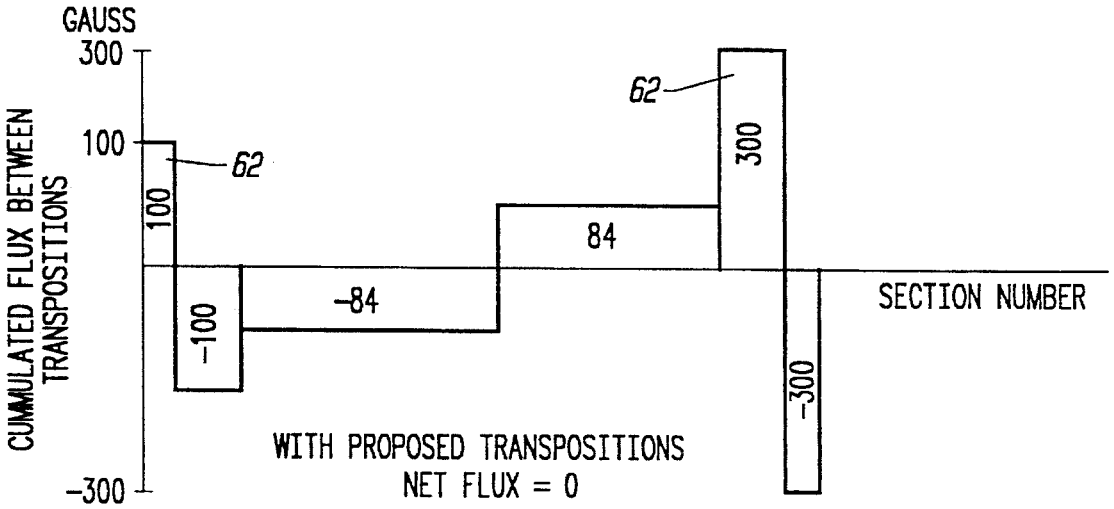
FIG. 7 is a diagrammatic representation of transformer transpositions and resultant flux leakage associated with the core-form transformer of the present invention.

A final aspect of the present invention is disclosed in relation to FIGS. 6 and 7. The present invention discloses an ideal transposing fold in FIG. 5. Another aspect of the present invention is to utilize this transposing fold only at selected optimal positions to reduce operating losses associated with circulating currents.

In the prior art, a transposition is usually made between each adjacent coil section. Thus, for instance, in a conventional core-form transformer with 20 coil sections, a transposition is made at each coil section. FIG. 6 depicts the result flux leakage associated with each coil section in a conventional 20 coil section core-form transformer. Each inverted value corresponds to a transposition. The resultant net flux is −118 Gauss.

In accordance with the present invention, the number of transposing folds is significantly reduced, thereby reducing manufacturing expenses. Moreover, notwithstanding the reduced transposing folds, operating losses are actually reduced in accordance with the invention.

In short, the transformer of the present invention accounts for the fact that the flux leakage at the ends of the transformer are larger than in the middle of the transformer, as reflected in FIG. 6, where the respective ends have flux leakages of 100 Gauss and −300 Gauss, while the middle coils have flux leakages of approximately 11 Gauss or −11 Gauss. The transformer of the present invention exploits this flux leakage pattern to reduce the number of transposing folds.

FIG. 7 depicts a flux leakage pattern for a sample transposing scheme for a transformer of the present invention. Initially, one should note that because ribbon conductors are employed with the present invention, fewer coil sections are required. In particular, in this example, only 6 coil sections (62) may be employed in a core-form transformer of the present invention.

The transposition scheme of the present invention includes transposing folds after the first coil section and before the last coil section of the transformer where the radial fluxes are highest (100 Gauss and −300 Gauss in FIG. 7). On the other hand, unlike the prior art, transposing folds are not made at each coil section. Instead, only a single transposing fold is made after the third coil section. Thus, with the example associated with FIG. 7, for a six coil section transformer, a transposing fold is made after the first coil section. Another transposing fold is made after the third coil section. The final transposing fold is made after the fifth coil section. In sum, three transpositions are made. In a more general form, with the present invention, a transposing fold is made adjacent to the first and last coil sections and at a given intermediate coil section.

The transposition scheme of the transformer corresponding to FIG. 7 results in a net flux loss of 0 Gauss. Therefore, with the transposition scheme of the present invention, less transposing folds are required and thus the transformer is less expensive to manufacture. Moreover, the resultant transposition scheme actually reduces operating losses.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A core-form transformer comprising:

a ribbon conductor, with opposing wide sides and opposing thin sides, formed from a plurality of rectangular conducting elements, each of said rectangular conducting elements including opposing wide sides and opposing thin sides, said opposing thin sides of said plurality of rectangular conducting elements being aligned to form said ribbon conductor;

a plurality of axially displaced coil sections wound from said ribbon conductor, including a first coil section axially displaced from a second coil section; and a transposition arrangement between said first coil section and said second coil section, said transposition arrangement including a set of folds causing an inside axially positioned rectangular conducting element of said ribbon conductor of said first coil section to be positioned as an outside axially positioned rectangular conducting element in said second coil section.

2. The core-form transformer of claim 1 wherein said transposition arrangement includes:

a first angled fold of said ribbon conductor oriented inside, said angled fold being formed on said first coil section;

a straight crease of said ribbon conductor oriented outside, said straight crease being formed over said first angled fold and axially extending said ribbon conductor away from said first coil section toward said second coil section; and a second angled fold of said ribbon conductor in-line, said second angled fold resulting in said ribbon conductor being positioned to form said axially displaced second coil section.

3. The core-form transformer of claim 1 further comprising:

a first transposition arrangement immediately adjacent to a first coil section;

a second transposition arrangement adjacent to an intermediate coil section; and a third transposition arrangement adjacent to a last coil section.

4. The core-form transformer of claim 1 wherein said ribbon conductor is enclosed by a c-wrapped insulating jacket.

5. A core-form transformer comprising:

a ribbon conductor, with opposing wide sides and opposing thin sides, formed from a plurality of rectangular conducting elements, each of said rectangular conducting elements including opposing wide sides and opposing thin sides, said opposing thin sides of said plurality of rectangular conducting elements being aligned to form said ribbon conductor;

a plurality of axially displaced coil sections wound from said ribbon conductor, including a first coil section axially displaced from a second coil section; and a transposing fold between said first coil section and said second coil section, said transposing fold including a first angled fold of said ribbon conductor oriented inside;

a straight crease of said ribbon conductor oriented outside, said straight crease being formed over said first angled fold and axially extending said ribbon conductor away from said first angled fold toward an axially displaced adjacent coil section; and a second angled fold of said ribbon conductor in-line, said second angled fold resulting in said ribbon conductor being positioned to form said axially displaced adjacent coil section.

6. The core-form transformer of claim 5 further comprising:

a first transposition arrangement immediately adjacent to a first coil section;

a second transposition arrangement adjacent to an intermediate coil section; and a third transposition arrangement immediately adjacent to a last coil section.

7. The core-form transformer of claim 5 wherein said ribbon conductor is enclosed by a c-wrapped insulating jacket.

* * * * *